US008984822B1

(12) United States Patent
Cline et al.

(10) Patent No.: US 8,984,822 B1
(45) Date of Patent: Mar. 24, 2015

(54) ROOF-PENETRATING PIPE SEALING

(71) Applicant: Lifetime Tool & Building Products, LLC, Winchester, VA (US)

(72) Inventors: Roger M. Cline, Bluemont, VA (US); Mark MacLean-Blevins, Westminster, MD (US)

(73) Assignee: Lifetime Tool & Building Products, LLC, Winchester, VA (US)

( * ) Notice: Subject to any disclaimer, the term of this patent is extended or adjusted under 35 U.S.C. 154(b) by 0 days.

(21) Appl. No.: 14/035,254

(22) Filed: Sep. 24, 2013

Related U.S. Application Data

(60) Provisional application No. 61/704,746, filed on Sep. 24, 2012.

(51) Int. Cl.
*F16L 58/18* (2006.01)
*E04D 13/14* (2006.01)

(52) U.S. Cl.
CPC ..... *F16L 58/185* (2013.01); *E04D 13/14* (2013.01)
USPC ..... 52/244

(58) Field of Classification Search
CPC ..... F16L 58/185; F24F 7/02; E04F 17/026; E04D 13/14; E04D 13/1407; E04D 13/1476
USPC ..... 52/219, 58–60, 198–199, 741.4; 285/42–45; 277/636, 312, 628
See application file for complete search history.

(56) References Cited

U.S. PATENT DOCUMENTS

| | | | | | |
|---|---|---|---|---|---|
| 1,923,220 | A | | 8/1933 | Lightbown | |
| 2,510,926 | A | * | 6/1950 | Goldstein | 285/43 |
| 3,436,880 | A | * | 4/1969 | Kifer | 52/58 |
| 3,731,952 | A | * | 5/1973 | Elwart | 285/3 |
| 3,797,181 | A | | 3/1974 | Nievelt | |
| 3,977,137 | A | * | 8/1976 | Patry | 52/60 |
| 4,115,961 | A | * | 9/1978 | Bishop | 52/58 |
| 4,372,585 | A | * | 2/1983 | Evora | 285/43 |
| 4,512,119 | A | * | 4/1985 | Willoughby | 52/58 |
| 5,245,804 | A | | 9/1993 | Schiedegger | |
| 5,347,776 | A | * | 9/1994 | Skoff | 52/219 |
| 5,390,451 | A | * | 2/1995 | Kopp et al. | 52/58 |
| 5,703,154 | A | * | 12/1997 | Davis et al. | 524/525 |
| 5,778,611 | A | * | 7/1998 | Michel | 52/198 |
| 6,244,006 | B1 | | 6/2001 | Shue | |
| D486,891 | S | | 2/2004 | Cronce | |
| D550,346 | S | | 9/2007 | Ness | |
| D554,749 | S | | 11/2007 | Ness | |
| 8,272,186 | B2 | | 9/2012 | Manning | |
| 8,413,687 | B1 | | 4/2013 | Woodring | |
| 8,484,914 | B2 | * | 7/2013 | Cline | 52/219 |
| 2011/0005156 | A1 | | 1/2011 | Laufer | |
| 2011/0302876 | A1 | * | 12/2011 | Giffin | 52/741.4 |
| 2013/0020796 | A1 | * | 1/2013 | Humber | 285/44 |

* cited by examiner

*Primary Examiner* — Jeannette E Chapman
(74) *Attorney, Agent, or Firm* — James Creighton Wray

(57) ABSTRACT

A roof-penetrating pipe is covered with a sealing pipe. An annular part overlies the roof-penetrating pipe and a downward extension fits into the roof-penetrating pipe to center the sealing pipe. A flexible seal has an upper part tightly gripping the sealing pipe. A compression ring compresses the upper part against the sealing pipe. The flexible seal is slid downward on the sealing pipe. A base on the flexible seal is secured to the roof. A roof penetrating pipe which is difficult to seal or which cannot be sealed due to corrosion, breakage or oxidation is covered with a cover sleeve apparatus. The cover sleeve provides a smooth sealing surface for application of a standard roof pipe flashing device. The cover sleeve is manufactured from materials to withstand the elements and to meet industry standard sizing.

29 Claims, 15 Drawing Sheets

ROOF-PENETRATING PIPE SEALING

This application claims the benefit of U.S. Provisional Application No. 61/704,746 filed Sep. 24, 2012, which is hereby incorporated by reference in its entirety as if fully set forth herein.

BACKGROUND OF THE INVENTION

Sealing around metal roof-penetrating pipes to prevent ingress of water and moisture presents problems. The metal pipes expand and contract with varied temperatures that a roof encounters. Ordinary seals and tars under stress over time periods, crack, become loose, and admit water and moisture to penetrate roofs around the through-roof pipes. Over time metal pipe surfaces exposed to the elements become corroded or oxidized and become extremely difficult or totally impossible to seal. Replacement of these damaged or impossible to seal preexisting metal pipes is costly and time-consuming. Hence sealing to these preexisting old corroded metal pipes presents a problem to be solved.

Roof-penetrating metal pipes have different diameters and thicknesses. As an example, cast iron pipes may have larger outer diameters and greater wall thickness as compared to smaller outer diameters and thinner walls of copper roof-penetrating pipes. This pipe size difference creates other problems to be solved.

Needs exist for improved roof-penetrating pipe seals and sealing.

SUMMARY OF THE INVENTION

The present invention provides a solution to the problem by covering the roof-penetrating metal, or other, pipe with a cover sleeve apparatus comprising a section of PVC (polyvinyl chloride) pipe and a connecting cap. The cover sleeve apparatus extends over and along the metal or other pipe into and through the roof flashing device seal portion and sometimes into the opening around the pipe in the roof substrate.

A roof flashing device comprising a flexible silicone boot, a base plate and a rigid compression ring seal is disclosed in U.S. patent application Ser. No. 12/803,176 filed Jun. 21, 2010, now U.S. Pat. No. 8,484,914, which is incorporated herein by reference as if fully disclosed herein. The rigid compression ring is trapped between enlarged beads near the top of the sealing boot. The body of the sealing boot is flexible and has one or more expanded bulges to provide flexibility and to allow the seal to be mounted on roofs of varied slopes. The base of the silicone sealing boot has an outer sealing edge and an inner dependent bead.

The mounting plate attaches to the inner depending bead of the sealing boot. The mounting plate has a flat peripheral portion to overlie and underlie successive ranks applied roofing material.

An integral oval raised middle portion of the mounting plate is formed upwards from the flat surface. The middle portion tapers from a larger height above the flat peripheral portion at the down-roof side to a smaller height at the up-roof side. An upper ledge of the middle portion is formed inward to lie beneath the lower sealing edge of the silicone sealing boot. An inner part of the upper ledge is reentrantly curved downward and then upward in an S-shaped cross-section to lock in the inner dependent bead of silicone sealing boot. The inner edge of the S-shaped cross section is directed downward, away from the boot.

The upper beads of the sealing boot trap the rigid compression ring. The upper beads tightly fit around and are slightly stretched over the PVC pipe. The sealing sleeve is pressed down along the PVC pipe during installation. A silicone lubricant is distributed around the top of the PVC pipe and/or inside the upper beaded portion of the silicone sealing boot before the sealing boot assembly is pressed downward along the PVC pipe and cap.

The rigid compression ring is placed between the upper and lower silicone retaining beads before the sealing assembly is shipped from the factory. The rigid compression ring remains in place between the two retaining beads as the silicone sealing boot is pressed downward along the PVC pipe and cap. The rigid compression ring has similar characteristics of expansion as the cover sleeve apparatus and retains the desired compression of the silicone sealing boot around the cover sleeve apparatus under all conditions. The cover sleeve apparatus surrounding and encasing the metal pipe solves any problems of further deterioration or damage to the metal pipe.

During fabrication and manufacturing of the cover sleeve apparatus, the connecting cap is permanently sealed to the one end of the PVC pipe section. Outer edges of the connecting cap are flush with the outer surface of the PVC pipe section. To solve the problems of varied metal pipe size and outer dimensions and wall thicknesses, the connecting cap has inner features. The connecting cap has a central opening that provides the intended venting of the preexisting roof-penetrating pipes. The connecting cap has a long downward inner cylindrical extension that fits within upper ends of preexisting roof-penetrating pipes. The cylindrical downward inner extensions are slightly outwardly tapered to thinner inwards ends spaced inward from the inner walls of the preexisting pipes. The tapering and spacing helps to ensure that rain water or moisture drops straight down into and through the preexisting vent-pipes and also helps to center and locate the cover sleeve apparatus on the preexisting vent pipes.

The thick sloping inner shelf of the connecting cap rests on top of the preexisting pipe, and an inner edge of the shelf is rounded inward from the top of the preexisting vent pipe. The thick shelf has a wide inner part bounded on an outer-side by a long downward tapered cylindrical extension that divides the lower surface of the shelf into a wider inner annular surface and a smaller outer annular surface. The wider inner surface is especially suited for a smaller outer dimension and a thicker wall of a cast iron pipe. The smaller outer annular surface is suited for supporting on top of a copper pipe.

The shelf has an outer wall that fits tightly against an inner wall of the cylindrical PVC pipe section. A radially extending rim of the connecting cap fits over the upper end of the PVC pipe section. The outer diameter of the rim is coextensive with the outer diameter of the PVC pipe section. Raised reinforcements extend between the upper surface of the shelf and the inner surface of the outer wall of the connecting cap to ensure dimensional stability of the connecting cap and the upper end of the PVC pipe section. The connecting cap is inseparably assembled on the top of the PVC pipe section at the factory by one or more of bonding, welding, fusing, or pressure fitting.

A roof-penetrating pipe seal includes the cover sleeve apparatus, also called herein a sealing pipe, for placing over a roof-penetrating pipe. The connection cap portion of the cover sleeve apparatus connects the sealing pipe, also called herein a cover sleeve apparatus, with the roof-penetrating pipe. The connection cap has an inner part fitting into the roof-penetrating pipe and a part extending from the roof-penetrating pipe. A roof flashing sealing boot fits over the cover sleeve apparatus. The roof flashing sealing boot has an upper portion tightly engaging and sealing the cover sleeve apparatus and having a lower flexible portion. The upper portion is adapted for sliding downward along the cover sleeve apparatus. A base has a lower portion for connecting to a roof. An upper portion of the base is connected and sealed.

The connection between the roof-penetrating pipe and the cover sleeve is the annular connection cap which is fitted over the top of the roof-penetrating pipe that supports the inner part that fits into the roof-penetrating pipe. The connecting cap has an upward extension and an outward extension for a permanent connection with the cover sleeve apparatus.

The upward extension has an outward extending and downward facing rim for joining the connecting cap to an upper end of the pipe section of the cover sleeve apparatus.

The connecting cap extends outward and upward, forming an annular cup with a central opening directing precipitation into the roof-penetrating pipe.

The connecting cap has an outer annular part extending downward along an outer wall of the roof-penetrating pipe. The inner part and the outer part of the connecting cap are tapered for aligning the cover sleeve apparatus on the roof-penetrating pipe.

A compression ring compresses the upper portion of the sealing boot on the cover sleeve apparatus. The upper position of the boot has spaced upper and lower outward projections trapping and holding the compression ring between the projections. The boot and the upper portion of the boot slide downward along the cover sleeve apparatus. The compression ring and the cover sleeve apparatus are made of the same material and have the same thermal coefficient of expansion. The upper portion of the boot has an inner dimension which is less than an outer dimension of the cover sleeve apparatus. The compression ring compresses a part of the upper portion of the boot between the compression ring and the cover sleeve apparatus.

Sealing a roof penetrating pipe includes placing a cover sleeve apparatus over the roof-penetrating pipe, connecting the cover sleeve apparatus to the roof-penetrating pipe and extending a part of the cover sleeve apparatus into the roof-penetrating pipe. A sealing boot is fitted over the cover sleeve apparatus, tightly engaging an upper portion of the sealing boot on an outside of the cover sleeve apparatus. A lower portion of the sealing boot is sealed to a base. The base is secured to the roof around the roof-penetrating pipe and the cover sleeve apparatus.

The method includes providing a connecting cap on the cover sleeve apparatus, providing an annular horizontal part of the connecting cap, providing an inner downward extension on the horizontal part, and fitting the inner downward extension into the roof-penetrating pipe.

An outer downward extension on the horizontal part is fitted on an outside of the roof-penetrating pipe.

An upward extension on an outer edge of the horizontal part provides an outward extending and downward facing rim. The rim is permanently sealed to an upper edge of the cylindrical pipe portion of the cover sleeve apparatus.

A cover sleeve apparatus is placed over a roof-penetrating pipe. An annular connecting cap is permanently joined on a top of the cylindrical pipe portion. The annular connecting cap has an annular inward extending part and an inner downward extension on an inner edge of the annular inward extending part fitting inside of a roof-penetrating pipe.

A sealing boot having an upper portion and a base portion tightly engages and seals the cover sleeve apparatus.

The upper portion is adapted for sliding downward along the outside diameter of the cover sleeve apparatus.

The base portion has an outwardly extending flange for connecting to a roof. A lower portion of the boot and an upper portion of the base are interconnected and sealed. Reinforcements connect to the annular inward extending part and the upward extending part.

These and further and other objects and features of the invention are apparent in the disclosure, which includes the above and ongoing written specification, with the claims and the drawings.

DETAILED DESCRIPTION

Figure 1:
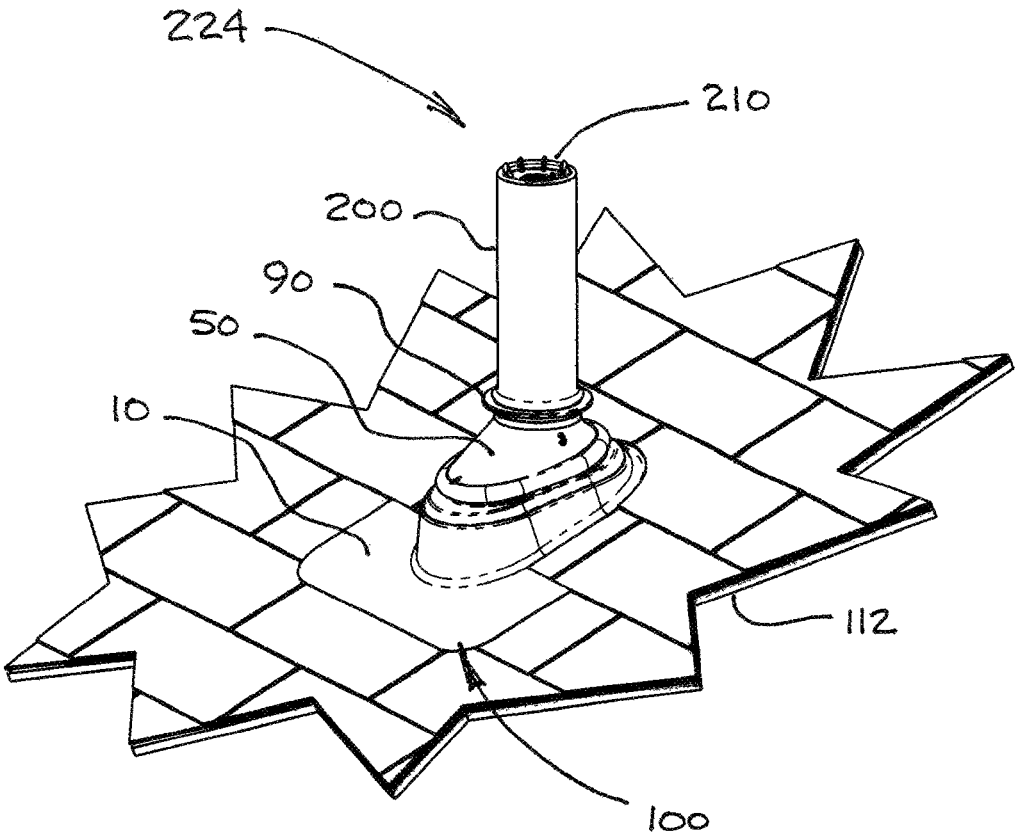
FIG. 1 is a perspective view of a through-roof seal assembly for a cast iron, copper or other roof-penetrating pipe.

In overall operation, the roof-penetration pipe sealing system comprising the cover sleeve apparatus of the present invention serves as a cover for the roof-penetrating element as well as providing a long-term, durable and reliable seal between the roof-penetrating element, the roof substrate and roof covering material. As shown in FIG. 1 the cover sleeve apparatus 224 has two main components: a cylindrical PVC pipe section 200 and a connecting cap 210. The roof seal apparatus 100 has three main components. A rigid base plate element 10 is the point of attachment to the roof substrate around the object to be sealed. A flexible transition member 50 is affixed to the base plate element in an inseparable manner and provides the seal to the roof-penetrating element. A rigid compression element 90 is positioned outside of the flexible transition element and is sized to constrain a uniform portion of the flexible transition element between the rigid compression element 90 and the PVC pipe section 200 of cover sleeve apparatus 224 covering the roof-penetrating object. The structures, the choice of materials used, the construction of the interfaces between the materials and the method of assembling the materials into the final cover sleeve apparatus, all combine to provide the unique attributes and performance of the new system.

FIGS. 1-15 portray the roof-penetrating pipe sealing at various stages. FIG. 1 shows a close up of the whole assembly including the cover sleeve apparatus 224 over a vent pipe in the roof 112 with the silicone sealing transition member 50 and rigid compression ring 90 on a metal mounting plate 10. This is but one of numerous embodiments in which the sealing system may be realized in accordance with the present invention.

Figure 2:
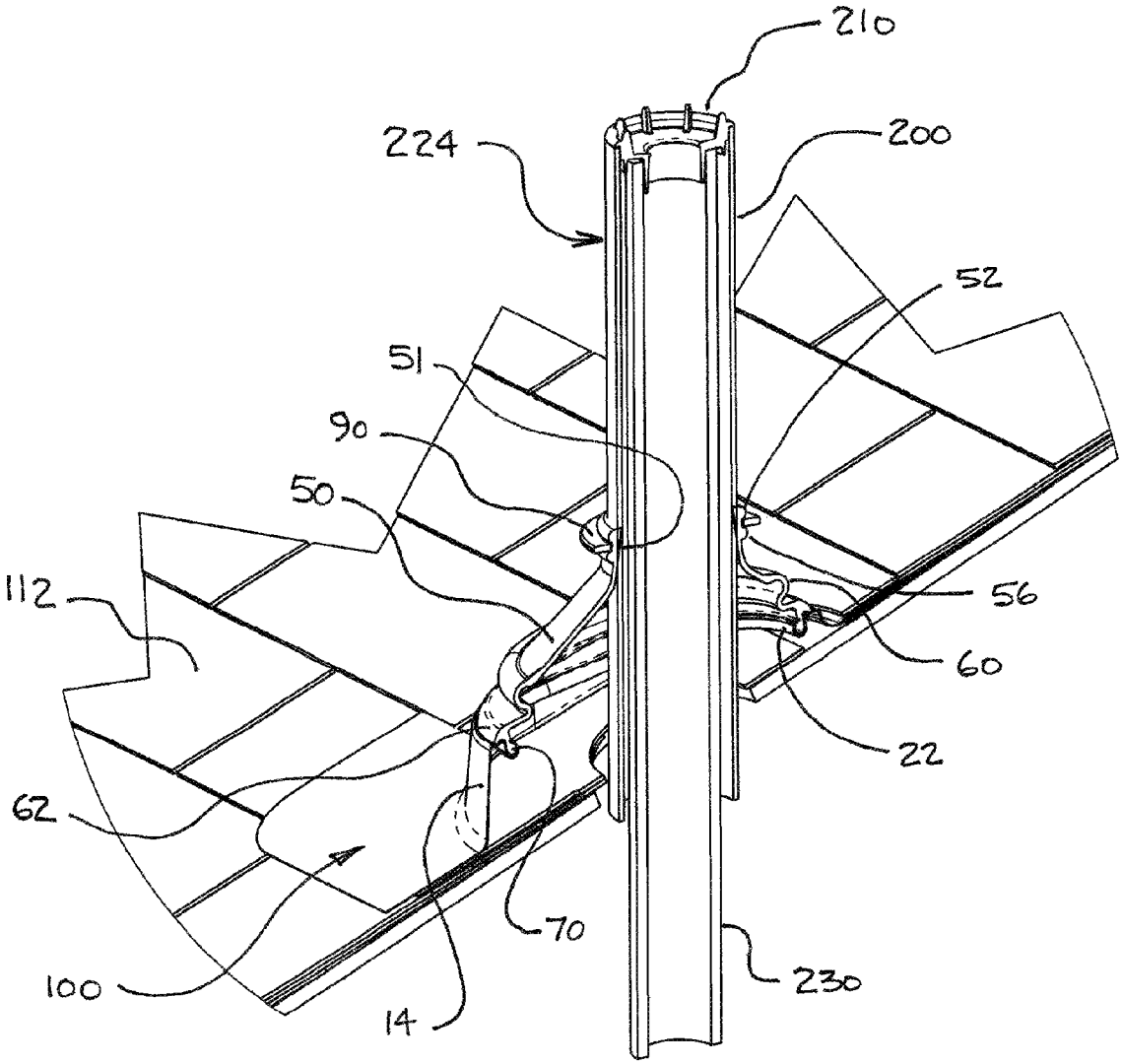
FIG. 2 is a cross-sectional perspective detail of the seal assembly shown in FIG. 1 used on a cast iron pipe that penetrates a roof.
Figure 3:
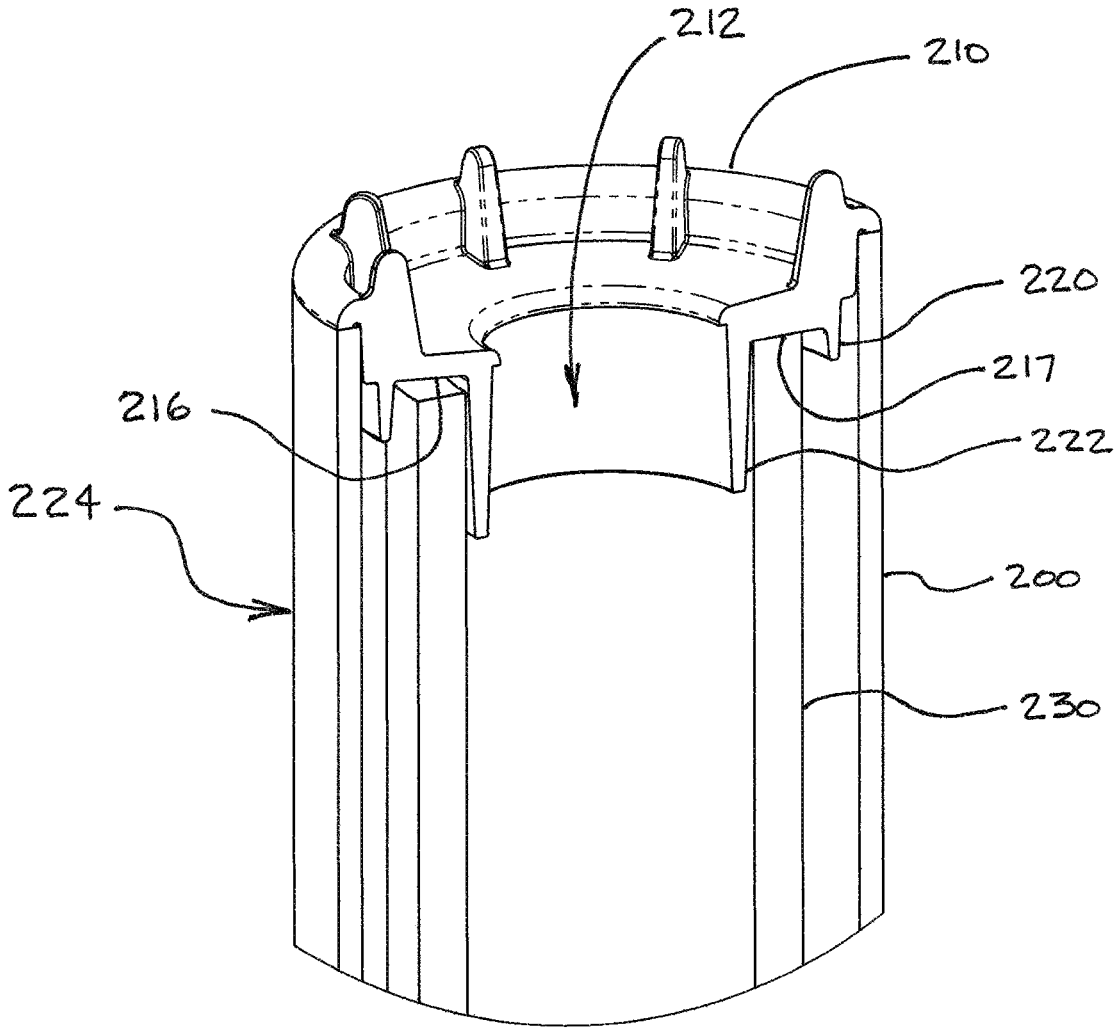
FIG. 3 is a cross-sectional perspective detail of the seal assembly shown in FIGS. 1 and 2 showing a detail of the connecting cap on the upper end of the seal assembly and the cast iron pipe.

FIGS. 2 and 3 shows cross-sections of the cover sleeve apparatus 224 over a cast iron pipe 230. FIG. 2 shows how the transition element 50 is held in place around the cylindrical PVC pipe section 200 by the rigid compression ring 90. The silicone sealing boot transition member 50 is inseparably attached to the mounting plate 10. As manufactured, an inner diameter of the upper seal portion 51 of flexible transition element 50 is formed slightly smaller than the cylindrical PVC pipe section 200 outside diameter, such that the seal portion 51 of the flexible transition element must stretch some small percentage as it is installed. Flexible transition element 50 is manufactured from a resilient elastomeric material such as silicone and is manufactured using a compression molding process that insures homogenous material properties throughout the molded part. The upper seal portion 51 of the flexible transition element 50 has two enlarged compression features, an upper stretch bead 52 and lower stretch bead 56. A factory-installed rigid compression ring 90 is trapped between enlarged beads 52, 56.

In effect, as the flexible transition element 50 is installed over the PVC pipe section 200, the inner surface of the sealing portion 51 of the elastomeric material stretches to fit the PVC pipe section 200 outside circumference. The sealing portion 51 and the enlarged beads 52 and 56 are slightly stretched over the PVC pipe section 200 and the effective outside diameter in the stretched area of flexible transition element seal portion 51 grows to a larger outer diameter. This outer diameter growth is not linear due to the reduction in cross-section caused by the stretching of the material. This new larger effective outer diameter of the seal portion of the flexible transition element 50 is restrained by rigid compression element 90, whose internal diameter is slightly smaller than the larger effective outer diameter in the uniform wall portion, thereby creating a compressive force or squeeze, on the flexible transition element 50 in the uniform wall portion at 51 between the rigid compression ring 90 and the PVC pipe section 200 of the cover sleeve apparatus 224.

The rigid compression element 90 is formed of a material with similar mechanical properties to the PVC pipe section 200. The material used in the rigid compression element 90 exhibits a similar coefficient of thermal expansion as the PVC pipe section 200. As the PVC pipe section 200 is changing dimension due to thermal changes, the rigid compression element 90 experiences the same thermal changes and changes dimension in a similar magnitude and at a similar rate as the pipe. By matching the thermal coefficient of expansion for both parts, the PVC pipe section 200 and the rigid compression element 90, uniform squeezing or compressive forces are applied to the sealing portion 51 of the flexible transition element 50. The magnitude of the compressive stress within the resilient material remains as uniform as possible throughout thermal gradients which occur on a daily cycle.

In addition, rigid compression element 90 serves to fully shield the uniform wall portion between stretch beads 52 and 56 from all sunlight UV exposure and from the elements. Lower stretch bead 56 is also partially protected from sunlight UV exposure and atmospheric elements by rigid compression element 90. The outside diameter and geometry of rigid compression element 90 is determined such that it provides adequate resistance to the compressive resultant forces from the flexible transition element 50 but is not so large diameter that it could become a damaging element under a snow or ice load. The best embodiment for rigid compression element 90 is as shown a single piece formed ring like structure; ideally manufactured from an injection molding grade of thermoplastic, more specifically rigid PVC.

The roof flashing sealing apparatus 100, also called a boot or flashing, as it is manufactured and shipped to the roof contractor or distributor has the sealing boot 50 inseparably attached to the mounting plate 10. The body of the sealing boot 50 is flexible with one or more bulges 60 to help to provide that flexibility such that the seal can fit on roofs 112 of varied slopes. At the base of the silicone sealing boot 50 is an outer sealing edge 62 and an inner dependent bead 70. Base plate 10 is die-stamped or roller formed of a rigid material capable of both being permanently affixed to the flexible transition element 50 and capable of being integrated under and within a roof covering material with ease. A galvanized and coated steel sheet of suitable alloys and plastic materials function well for this part. The base plate 10 is formed to accommodate the assembly to the flexible transition boot element 50, and boot 50 is formed to facilitate and at least partially accommodate variations in roof structure pitch that are encountered at installation.

The raised middle portion 14 of the base plate is tapered and from a larger height at the down-roof side to a smaller height at the up-roof side. The raised oval portion 14 of the mounting base 10 connects to the silicone sealing boot 50 by the inner dependent bead 70. An inner portion of the uppermost ledge part of the metal mounting plate 10 is reentrantly curved downward and then upward in an S shaped cross-section lock portion 22 to lock into the inner dependent bead 70 of the silicone boot 50. Base plate 10 has the portion 22 formed to receive match and mate with the bead 70 on the underside of the flexible transition element 50. Crimping the lock portion around bead 70 irreversibly locks the boot 50 to the plate 10. The inner edge of the lock portion 22 is turned downward so as not to touch the boot 50. Some installations, such as those with particularly harsh environmental extremes, may require an added level of protection, and as such an adhesive, bond, sealant, caulk compound or the like can be applied between top surface 14 receiver portion 22 and bead 70. The oval surface 14 is larger than the corresponding portion of the boot 50, leaving a small peripheral portion of top surface ledge exposed. The inner edge of the lock portion 22 is turned downward so as not to touch the boot 50. This slight set-back of the elastomer portion from the rigid base plate sloping surface 14 helps to prevent separation of the flexible transition element 50 from the base plate 10 due to ice intrusion.

The bead of elastomeric material 70 is trapped and squeezed by the plate's ledge surface receiver 22. The receiver 22 is crimped or rolled and deformed into bead-capturing position. For a base plate 10 made from a steel or other metal alloy this forming operation is commonly called a crimp or sizing operation moving the metal feature past its elastic limit to form a permanent new feature. Should the base plate be made from a plastic or other non-ferrous material, a heat operation can be utilized to form the material and then re-freeze the material to a new permanent shape.

In another embodiment, the flexible transition element 50 could be formed to the base plate 10 as part of the molding process, commonly known as over-molding, two shot or insert-molding. In this embodiment, no crimp or form operation would be required. The moldable resilient material used for the flexible transition element would be molded directly to the base plate part 10, requiring no further assembly processes to create the inseparable assembly.

FIG. 3 is an enlargement of the cross-section at the connecting cap 210 of the cover sleeve apparatus 224. The cast iron pipe 230, which may have smaller outer diameters and greater wall thickness, fits snugly into the connecting cap 210. The cast iron pipe 230 fits in between the long downward tapered cylindrical extension 222 and the short downward tapered cylindrical extension 220. Spacers 217 molded into and spaced along the wider inner surface 216 of the connecting cap 210 rest on the top of the pipe 230 made of metal or other material. The long downward tapered cylindrical inner extension 222 forms a central opening 212 in the cap 210 that allows gas to exit and rain water to enter the pipe 230.

Figure 4:
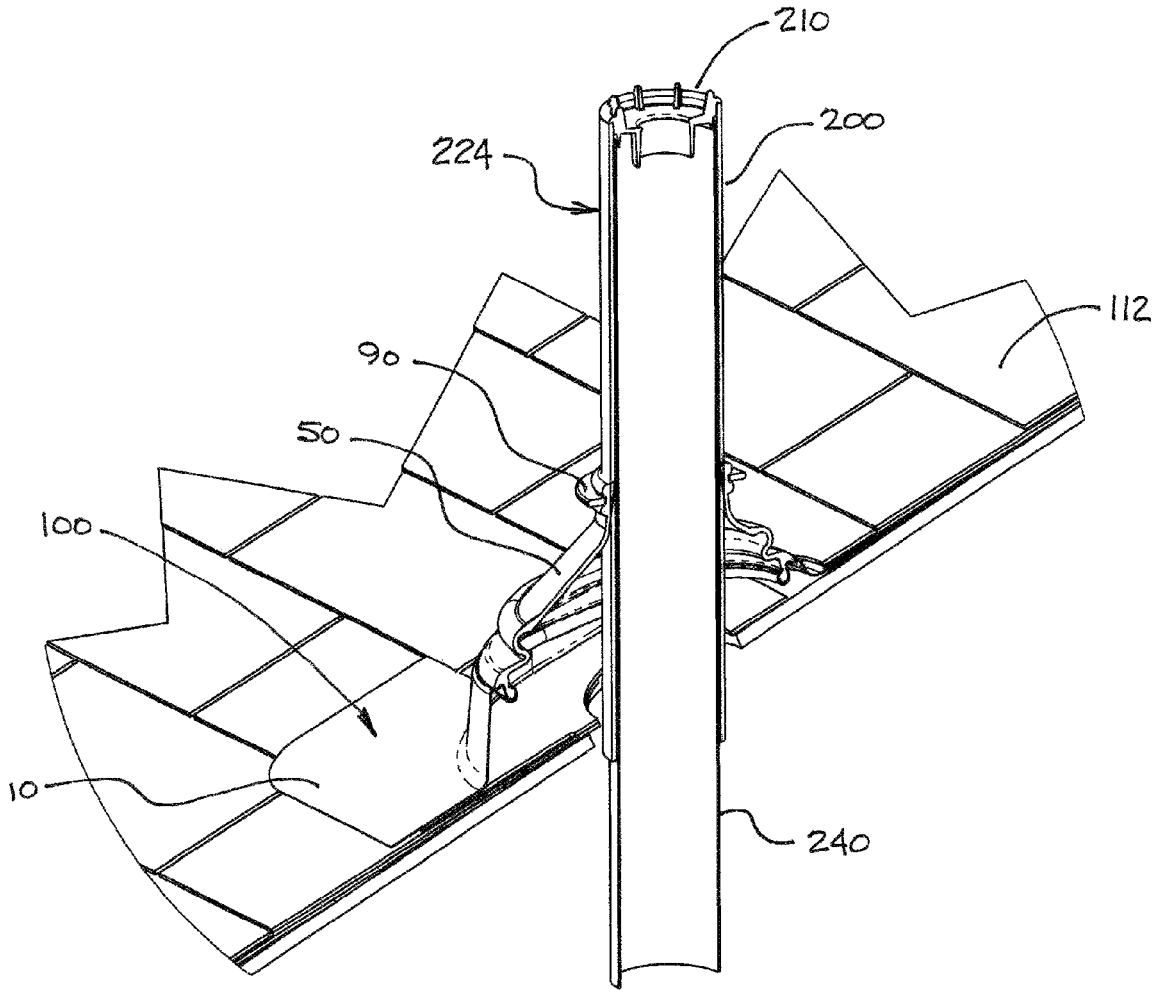
FIG. 4 is a cross-sectional perspective detail of the seal assembly shown in FIG. 1 used on a copper pipe that penetrates a roof.
Figure 5:
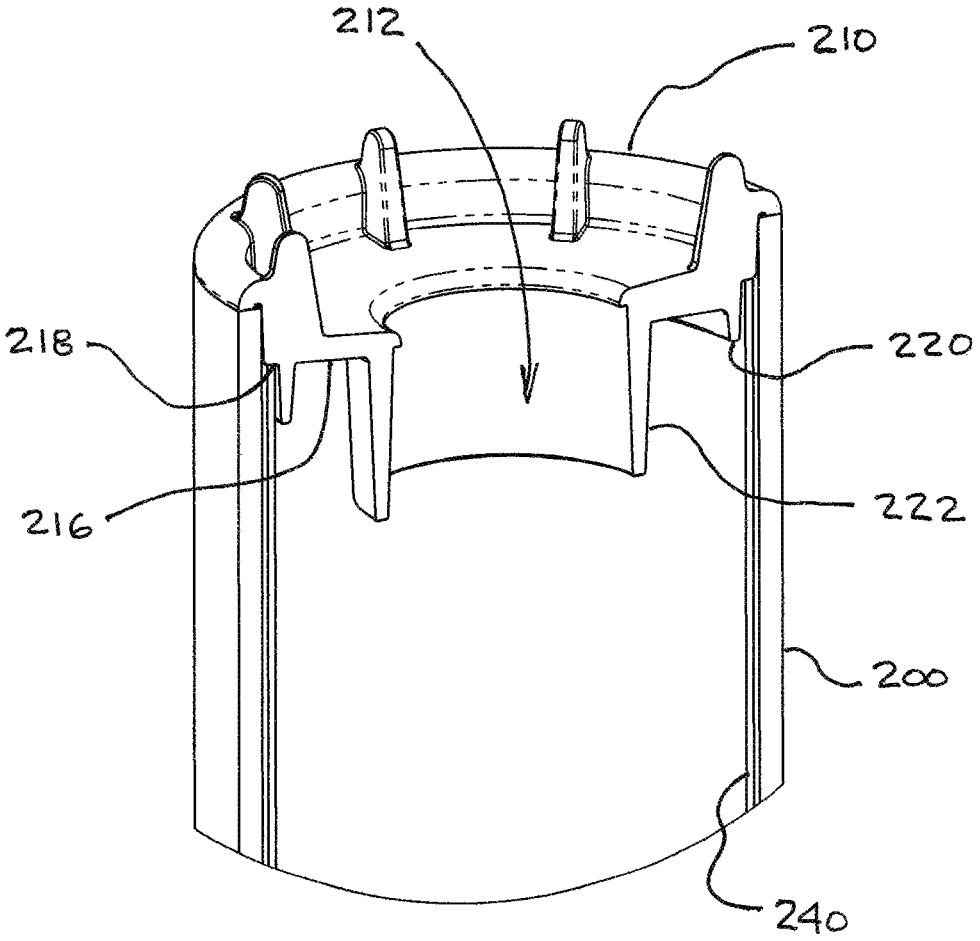
FIG. 5 is a cross-sectional perspective detail of the seal assembly shown in FIGS. 1 and 4 showing the upper end and cap of the seal assembly and the copper pipe.

FIGS. 4 and 5 show cross-sections of the cover sleeve apparatus 224 over a copper pipe 240. Despite the differences in material, size and thickness of pipe 240, the cover sleeve apparatus 224 covers and protects the copper pipe in the same way as the cast iron pipe.

FIG. 5 is an enlargement of the cross-section of the connecting cap 210 connected to the upper end of the PVC pipe section 200. The copper pipe 240, which may have a different outer diameter and thinner walls than a cast iron pipe fits snugly into the connecting cap 210 even though this is the same connecting cap that fits over the previously illustrated cast iron pipe 230. The copper pipe 240 fits between the short downward tapered cylindrical extension 220 and the inside of the PVC pipe section 200. The smaller outward-positioned inner surface 218 of the connecting cap 210 rests on the top end surface of the copper pipe 240. The long downward tapered cylindrical extension 222 forms a central opening 212 in the connecting cap 210 that allows gas to exit and rain water to enter the copper pipe 240.

Figure 6:
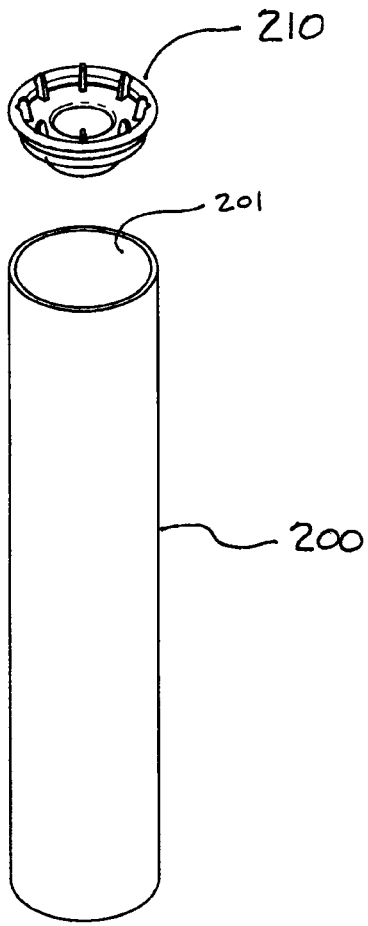
FIG. 6 is an exploded perspective view of the cover sleeve apparatus used to cover the cast iron or copper pipe shown in FIGS. 1-5.
Figure 7:
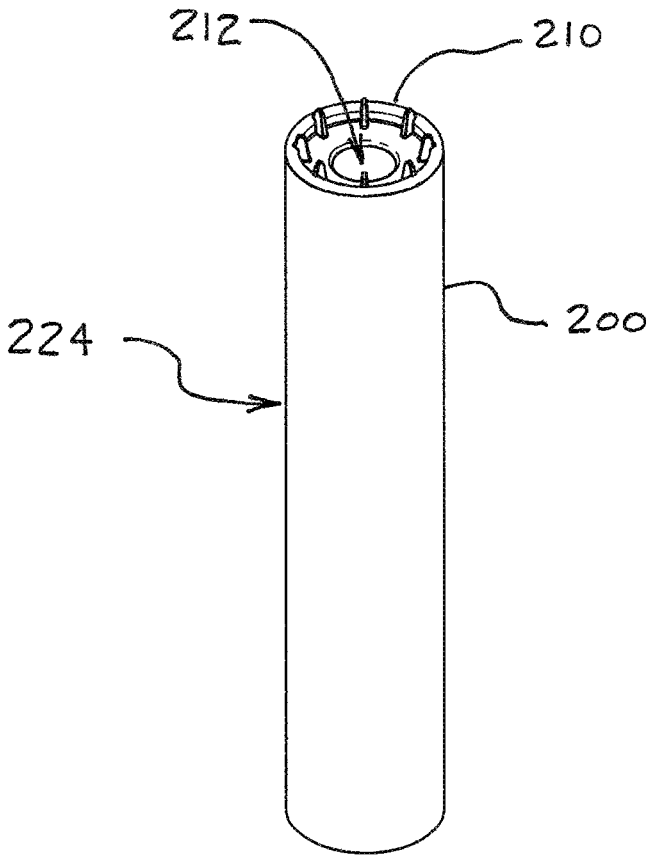
FIG. 7 is an assembled view of the cover sleeve apparatus used to cover the cast iron or copper pipe in the seal assembly shown in FIGS. 1-5.

FIGS. 6 and 7 show the cover sleeve apparatus 224 in detail. FIG. 6 shows an exploded view of the cover sleeve apparatus 224 prior to assembly. The connecting cap 210 is assembled on the top end of the cylindrical PVC pipe section 200 at the factory by one or more of bonding, welding, fussing, or pressure fitting. FIG. 7 shows cover sleeve apparatus 224 as manufactured and ready for use as a cover for a preexisting vent pipe. The central opening 212 in the cap 210 allows gas to exit and rain water to enter the preexisting pipe.

Figure 8:
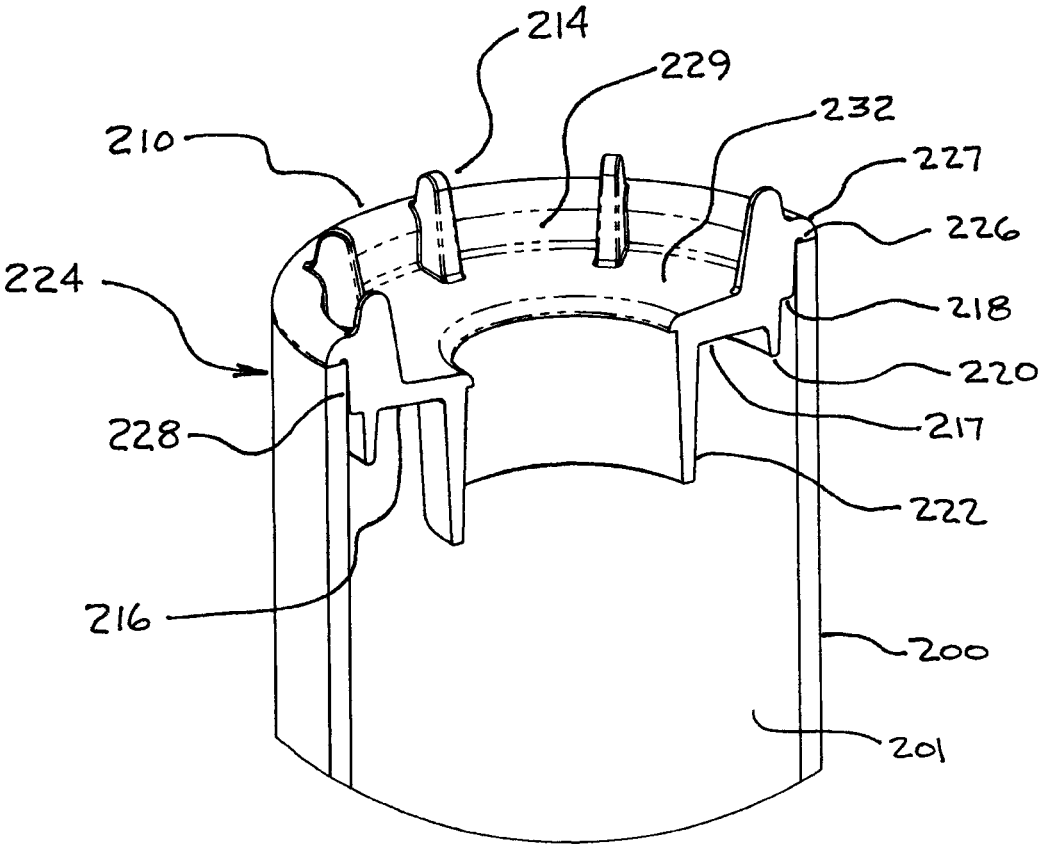
FIG. 8 is an enlarged cross-sectional top perspective detail of the cover sleeve apparatus shown in FIGS. 1-7.
Figure 9:
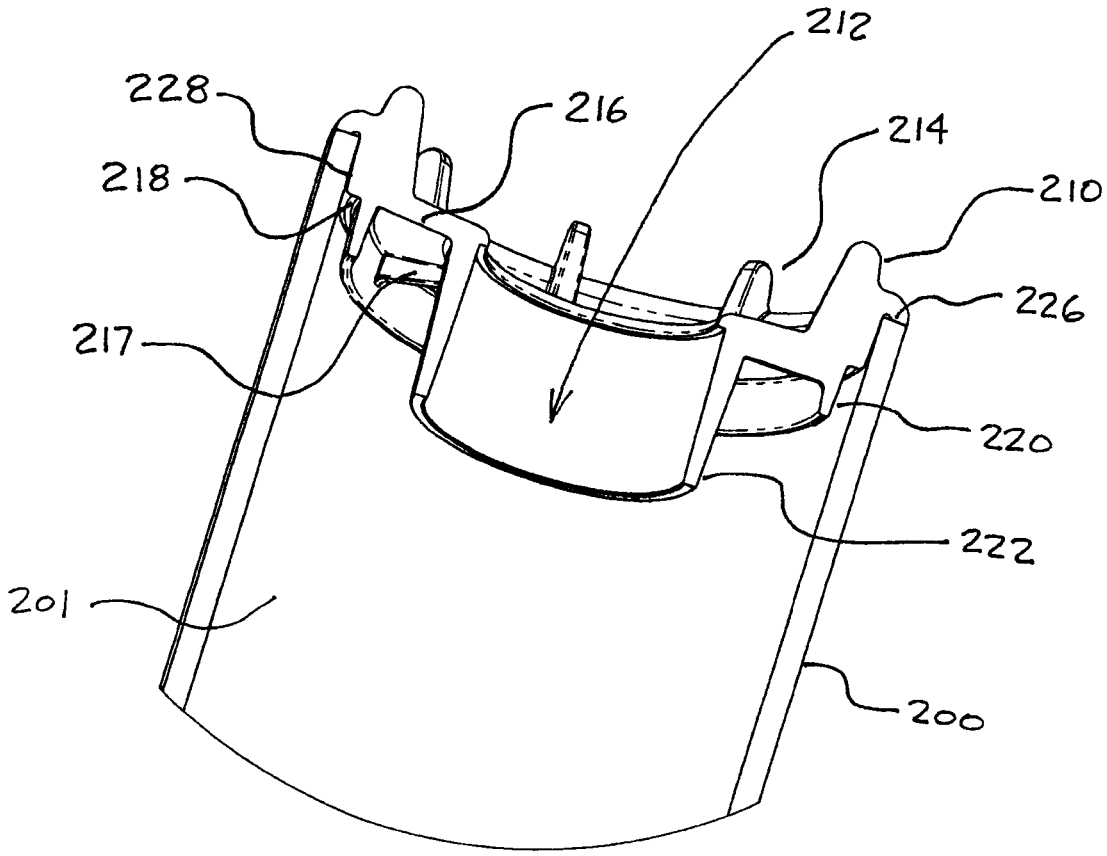
FIG. 9 is an enlarged cross-sectional bottom perspective detail of the cover sleeve apparatus shown in FIGS. 1-8.

FIGS. 8 and 9 show details of the cover sleeve apparatus 224, pipe section 200 and connecting cap 210 from different perspectives. A lower outer vertical wall surface 228 of connecting cap 210 is slightly larger in diameter than the inner wall 201 of the cylindrical PVC pipe section 200 providing a slight interfering fit when assembled. Above the outer vertical wall surface 228 a rim 226 extends to the outer diameter of the PVC pipe section 200. An annular outer cap surface 227 with a semi-circular cross section extends upward and inward from an outer edge of rim 226 to a cylindrical vertical wall 229. The annular flat surface 232 of connecting cap 210 extends from the central opening 212 to the vertical wall 229, which is opposite the outer vertical surface 228 of the connecting cap 210. Reinforcements 214 extend between the upper surface 232 and the inner surface 229 of the outer wall of the cap 210 that makes to ensure dimensional stability of the connecting cap 210 and the upper end of the PVC pipe section 200. Reinforcements 214 also assist in preventing accidental blockages of the vent opening 212 by random leaves, birds or debris. Rigidifying spacers 217 extend between the lower surface 216 of the shelf 232 and the short and long downward tapered cylindrical extensions 220 and 222 of the connecting cap 210. Reinforcements 214 also serve as torsion members during assembly of the connecting cap 210 to the pipe section 200, either during solvent welding operation or spin welding operations the connecting cap 210 must be rotated relative to the pipe section 200 and reinforcement 214 allow for proper holding to accomplish the relative rotation operations.

Figure 10:
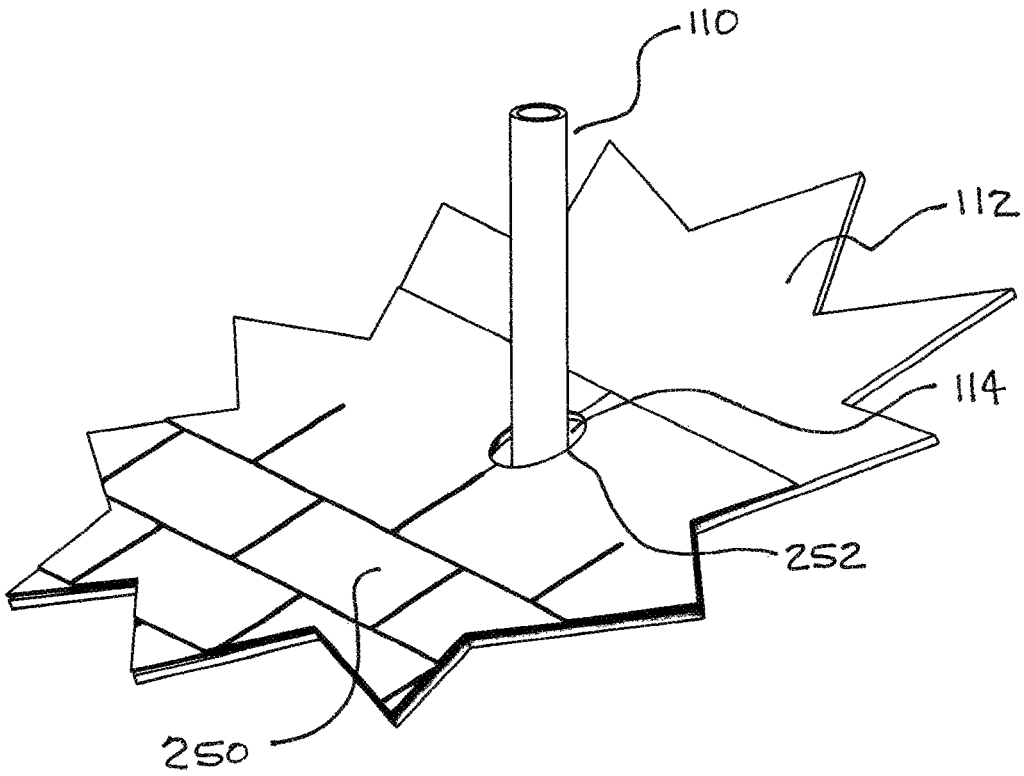
FIG. 10 is a perspective view of covering a roof having a cast iron, copper or other roof-penetrating vent pipe.

FIGS. 10-15 show the entire assembly process. FIG. 10 shows the roof 112 with roofing material layers 250 and the vent pipe 110 rising through the opening in the roof 114. An opening 252 is cut in the layers.

Figure 11:
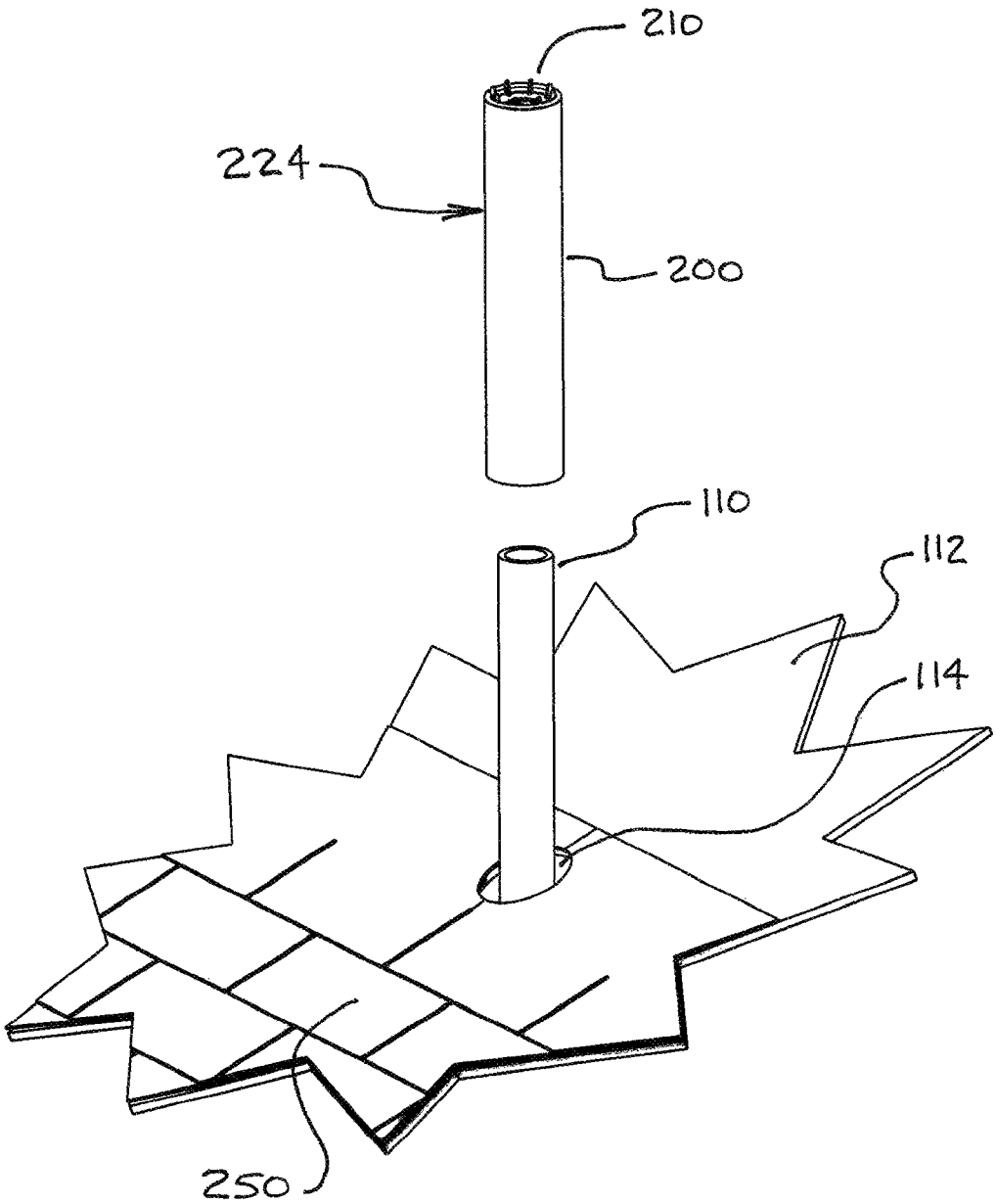
FIG. 11 is an exploded perspective view of a cover sleeve apparatus ready for placing on and surrounding the roof-penetrating cast iron or copper pipe.
Figure 12:
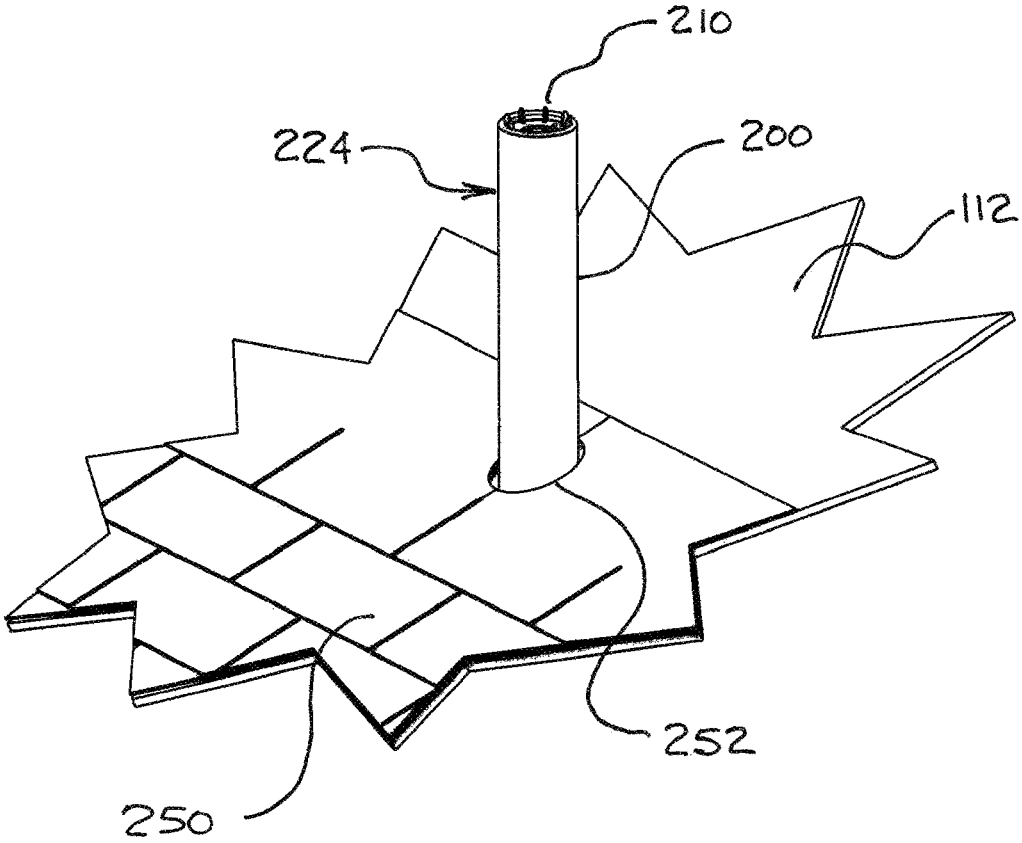
FIG. 12 shows the cover sleeve apparatus covering the cast iron or copper pipe with a lower end of the cover sleeve apparatus penetrating the roof.

FIGS. 11 and 12 show how the cover sleeve apparatus 224 is installed and fits over the vent pipe 110. PVC pipe section 200 passes through the opening 114 in the roof 112, however in given situations the end of the PVC pipe section 200 would not always need to pass through the roof substrate 112. As long as the terminal end of the PVC pipe section 200 is below the sealing portion of the roof flashing 100 the system performs to seal the roof penetration.

Figure 13:
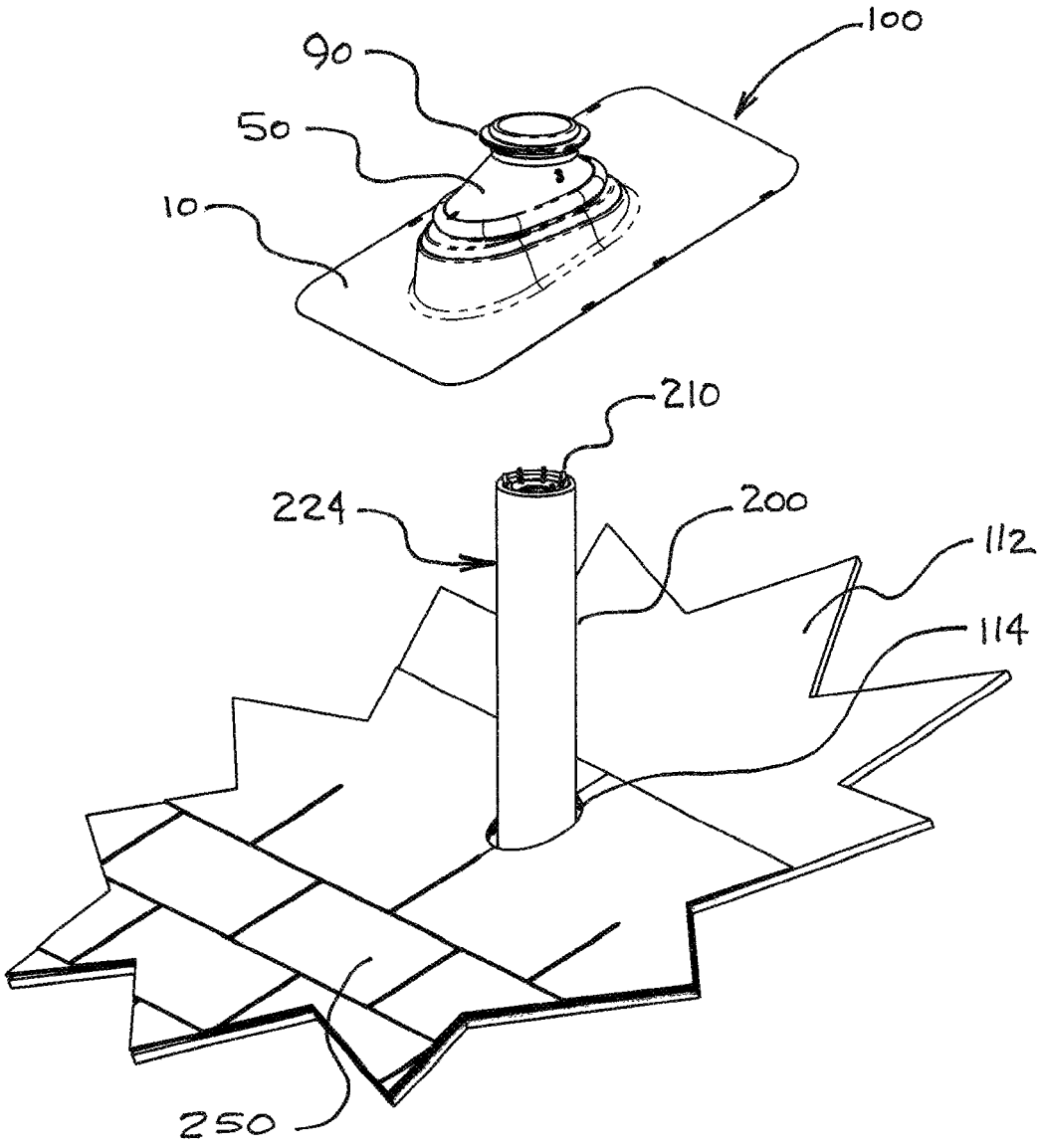
FIG. 13 shows a silicone seal and mounting plate ready to slide over the cover sleeve apparatus.
Figure 14:
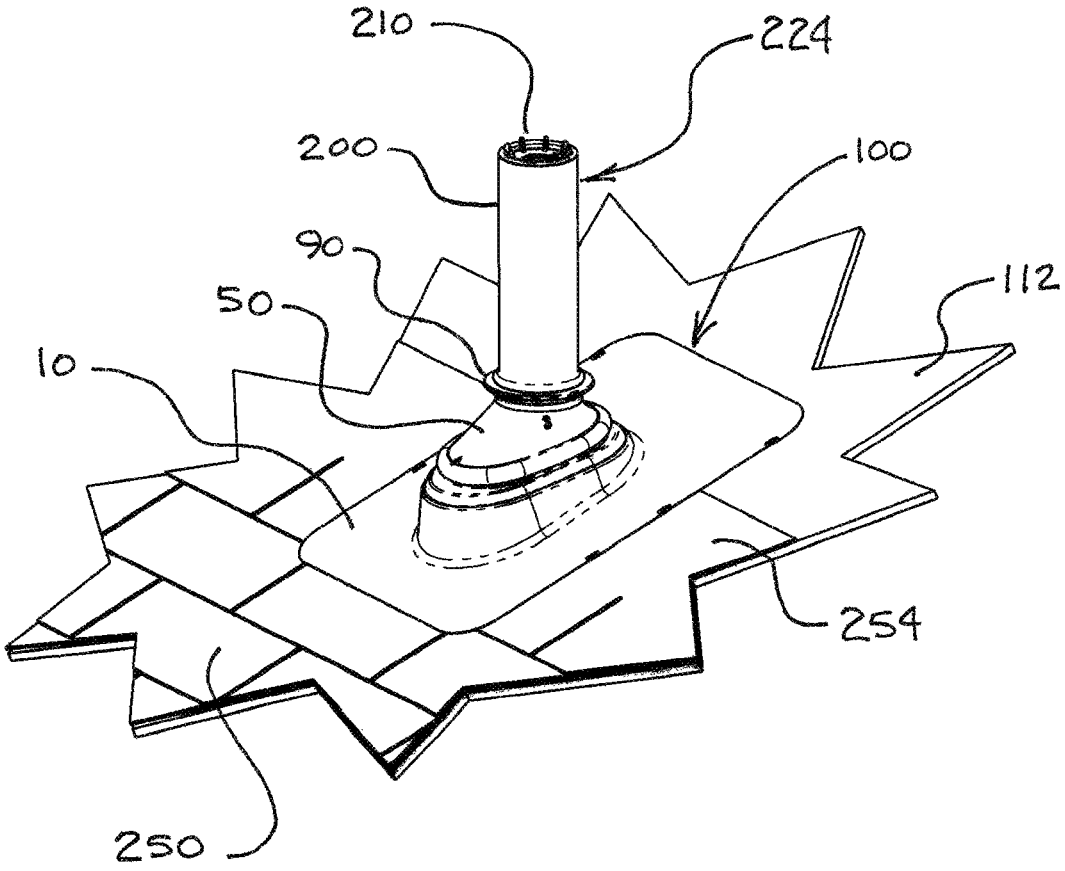
FIG. 14 shows the silicone seal and mounting plate in place sealing the cover sleeve apparatus.

Referring to FIGS. 13 and 14, roof-penetrating pipe 110 extends through a hole 114 in the roof substrate 112. The exterior surface of the cover sleeve apparatus 224 is wiped with a factory-supplied towelette impregnated with silicone oil and roof flashing 100 is installed over the cover sleeve apparatus 224 and is pushed downward along pipe section 200 onto roof substrate 112 and upper layer 254 of the roof covering layers. The plate 10 is then nailed to the roof substrate 112 though preformed holes in the plate.

To facilitate installation on a pipe and to help insure longevity of the flexible transition element 50 a lubricant may be added to the inner surface the upper portion 51 of the boot 50 of the sealing portion prior to installation onto the cover sleeve apparatus 224. This lubricant may be added to the system in the factory as part of the manufacturing process or it may be added in the field just prior to installation The geometric oval structure, bulbous portion 60 and elastomeric properties of flexible seal boot element 50 allows the sealing system roof flashing 100 to be applied to roof structures of varying pitch from a flat roof to a steeply sloped roof.

The factory-installed rigid compression ring 90 remains in place between the two retaining beads 52 and 56 as the silicone sealing boot 50 is pressed downward along the cover sleeve 224. The rigid compression ring 90 has similar characteristics of expansion to the PVC pipe section 200 and retains the desired compression of the silicone around the PVC pipe section 200 under all conditions. The cover sleeve apparatus 224 surrounds and encases the preexisting pipe and solve any problems of deterioration or damage to or leakage around the preexisting pipe.

Figure 15:
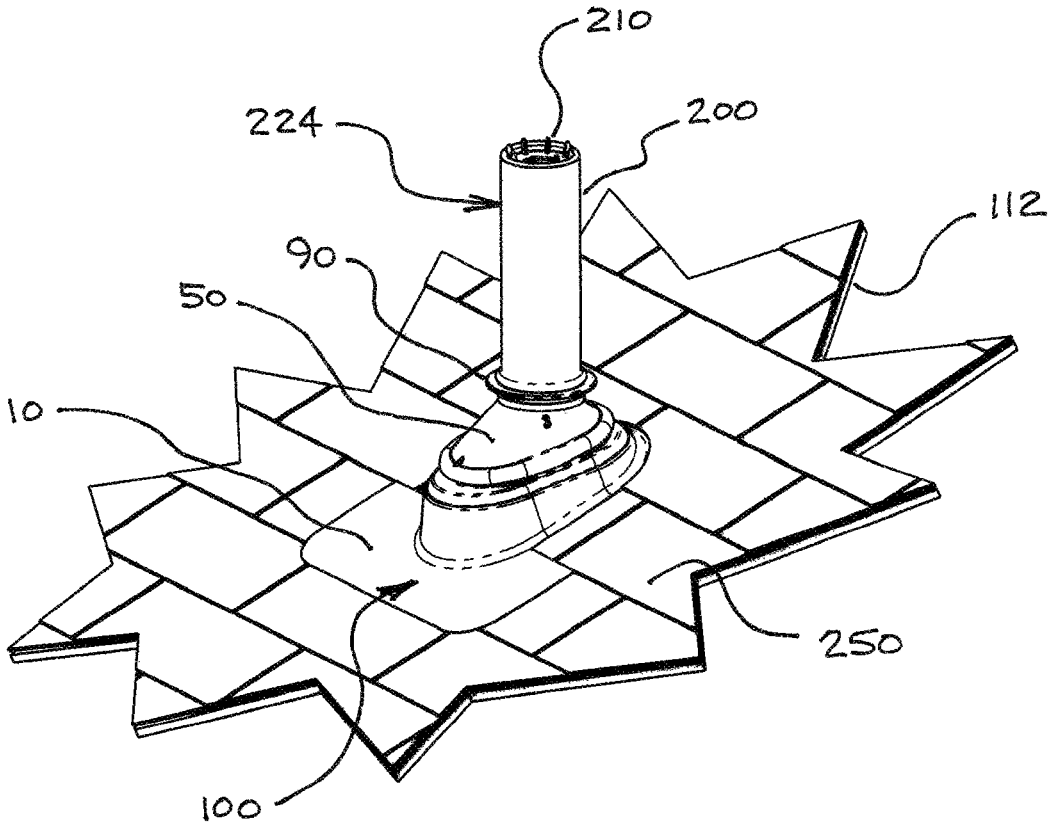
FIG. 15 shows the installation of roofing material over the base plate and around the silicone roof flashing seal.

FIG. 15 shows the final assembly with complete roofing materials. The flat peripheral portion of the base plate 10 is made to overlie and underlie successive ranks of applied roofing material 250.

While the invention has been described with reference to specific embodiments, modifications and variations of the invention may be constructed without departing from the scope of the invention, which is defined in the following claims.

We claim:

1. An apparatus comprising:

a rigid smooth cylindrical tubular cover sleeve for placing over a roof penetrating pipe, the rigid smooth cylindrical tubular cover sleeve further comprising a predetermined length of a rigid smooth cylindrical hollow tube, a rigid annular connecting cap fixed within a top of the rigid smooth cylindrical tube of said cover sleeve, a downward cylindrical extension permanently attached to an inner part of the connecting cap, said rigid cylindrical hollow tube adapted to fit over a roof penetrating pipe, said connecting cap adapted to fit inside a top of a roof penetrating pipe, and said downward cylindrical extension adapted to fit inside of the roof penetrating pipe.

2. The apparatus of claim 1, wherein the connecting cap with the downward cylindrical extension further comprises an internal annular opening for fluid communication between the interior of the roof penetrating pipe and the atmosphere outside of the roof system.

3. The apparatus of claim 1, wherein the connecting cap is inseparably assembled to the cylindrical hollow tube.

4. The apparatus of claim 1, wherein the rigid smooth cylindrical hollow tube is adapted to fit over various pipe outer diameters and to provide an outer diameter of the rigid smooth cylindrical hollow tube equivalent to published national standards.

5. The apparatus of claim 1, wherein the connecting cap provides a horizontal inner, lower surface for resting upon the top surface of the roof penetrating pipe.

6. The apparatus of claim 5, wherein the connecting cap is sealed to the roof penetrating pipe by application of an adhesive caulk to the top surface of the roof penetrating pipe prior to installation of the cover sleeve.

7. The apparatus of claim 1, further comprising a roof flashing on an outer side of the rigid smooth cylindrical hollow tube and sealing the rigid tubular cover sleeve and a roof, the roof flashing being adapted for fastening to a roof.

8. The apparatus of claim 7, wherein the roof flashing further comprises:

a resilient sealing boot fitting over the rigid cylindrical hollow tube of the cover sleeve, the resilient sealing boot having an upper portion tightly engaging and sealing the rigid cylindrical hollow tube of the cover sleeve and having a lower flexible portion, the upper portion being adapted for sliding downward along the cover sleeve, a base having a lower portion for supporting on a roof and for connecting to a roof and having an upper portion, the lower flexible portion of the resilient sealing boot and the upper portion of the base being interconnected and sealed.

9. The apparatus of claim 8, further comprising a compression ring on the upper portion of the resilient sealing boot.

10. The apparatus of claim 9, wherein the upper position of the boot has spaced upper and lower outward projections trapping and holding the compression ring between the projections when the resilient sealing boot and the upper portion of the resilient sealing boot slides downward on the cover sleeve.

11. The apparatus of claim 9, wherein the upper portion of the resilient sealing boot has an inner dimension which is less than an outer dimension of the rigid cylindrical hollow tube of the cover sleeve, and wherein the compression ring compresses a part of the upper portion of the resilient sealing boot between the compression ring and the rigid cylindrical hollow tube of the cover sleeve.

12. A system for sealing a roof penetrating pipe comprising:

a rigid cover sleeve for placing over a roof penetrating pipe, the rigid cover sleeve further comprising a rigid cylindrical hollow tube, a rigid annular connecting cap permanently attached to a top of the rigid cylindrical tube extending inward therefrom, and resting on a top of the roof penetrating pipe, a downward cylindrical extension permanently attached at an inner part of the connecting cap, the connecting cap of said cover sleeve being adapted to cover a top of the roof penetrating pipe and said downward cylindrical extension adapted to fit partially within said roof penetrating pipe, a roof flashing device sealed to the rigid cylindrical tube of the said cover sleeve, said roof flashing device simultaneously attached to the roof substrate, roof covering materials layered beneath and above said roof flashing device to provide a water-shedding roof covering.

13. The system of claim 12, wherein the rigid cylindrical tube of the cover sleeve is adapted to be equivalent in outer diameter to published standards to allow use with industry standard fitments and flashing seals.

14. The system of claim 12, wherein the connecting cap of the cover sleeve is further sealed to the roof penetrating pipe by the addition of an adhesive sealant to a top surface of the roof penetrating pipe prior to installation of the cover sleeve.

15. The system of claim 12, wherein the roof flashing device further comprises:

a resilient sealing boot fitting over the rigid cylindrical tube of the cover sleeve, the resilient sealing boot having an upper portion tightly engaging and sealing the rigid cylindrical tube of the cover sleeve and having a lower flexible portion, the upper portion being adapted for sliding downward along the rigid cylindrical tube of the cover sleeve, a base having a lower portion for supporting on a roof and for connecting to a roof and having an upper portion, the lower flexible portion of the resilient sealing boot and the upper portion of the base being interconnected and sealed.

16. The system of claim 15, further comprising a compression ring on the upper portion of the resilient sealing boot.

17. The system of claim 16, wherein the upper position of the resilient sealing boot has spaced upper and lower outward projections trapping and holding the compression ring between the projections when the resilient sealing boot and the upper portion of the resilient sealing boot slides downward on the rigid cylindrical tube of the cover sleeve.

18. The system of claim 16, wherein the upper portion of the resilient sealing boot has an inner dimension which is less than an outer dimension of the rigid cylindrical tube of the cover sleeve, and wherein the compression ring compresses a part of the upper portion of the resilient sealing boot between the compression ring and the rigid cylindrical tube of the cover sleeve.

19. A method for sealing a roof penetrating pipe comprising the steps of:

providing and installing a cover sleeve over the roof penetrating pipe, the providing of the cover sleeve further comprising providing a predetermined length of a rigid cylindrical hollow tube of said cover sleeve, providing an annular rigid connecting cap fixed within a top of the rigid cylindrical hollow tube of said cover sleeve, providing a downward cylindrical extension fixed to an inner part of the annular rigid connecting cap and adapted to fit inside the roof-penetrating pipe, connecting the rigid connecting cap of the cover sleeve to a top of the roof penetrating pipe, extending the downward cylindrical extension into an upper end of the roof penetrating pipe, applying a roof pipe flashing device over and onto the rigid cylindrical hollow tube of the cover sleeve, connecting the base of the roof pipe flashing device to a roof substrate, and applying roof covering materials under and over the roof flashing device to complete a water-shedding roof installation.

20. The method of claim 19, wherein a seal by the cover sleeve is enhanced by the application of an adhesive sealant on the roof penetrating pipe top surface prior to the step of installing the cover sleeve.

21. The method of claim 19, wherein the providing the roof flashing device further comprises:

providing a base, providing a resilient sealing boot fitting over the rigid cylindrical hollow tube of the cover sleeve, the resilient sealing boot having an upper portion tightly engaging and sealing the rigid cylindrical hollow tube of the cover sleeve and having a lower flexible portion, the upper portion being adapted for sliding downward along the rigid cylindrical hollow tube of the cover sleeve, the base having a lower portion for supporting on a roof and for connecting to a roof and having an upper portion, the lower flexible portion of the resilient sealing boot and the upper portion of the base being interconnected and sealed.

22. The method of claim 21, further comprising providing a compression ring on the upper portion of the resilient sealing boot.

23. The method of claim 22, wherein the upper position of the resilient sealing boot has spaced upper and lower outward projections trapping and holding the compression ring between the projections when the resilient sealing boot and the upper portion of the resilient sealing boot slides downward on the rigid cylindrical hollow tube of the cover sleeve.

24. The method of claim 22, wherein the upper portion of the resilient sealing boot has an inner dimension which is less than an outer dimension of the rigid cylindrical hollow tube of the cover sleeve, and wherein the compression ring compresses a part of the upper portion of the resilient sealing boot between the compression ring and the rigid cylindrical hollow tube of the cover sleeve.

25. The method of claim 21, wherein a lubricant is applied to inner surfaces of the upper portion of the sealing boot and to outer surfaces of the rigid cylindrical hollow tube of the cover sleeve prior to the step of applying the sealing boot to the rigid cylindrical hollow tube of the cover sleeve and sliding the sealing boot downward along the cover sleeve.

26. The system of claim 12, wherein a lubricant is applied to an inner surface of the roof flashing device and to an outer surface of the rigid cylindrical hollow tube of the cover sleeve apparatus before sliding the roof flashing device along the rigid cylindrical hollow tube of the cover sleeve apparatus.

27. The apparatus of claim 1, wherein the cover sleeve permits the enclosure of the existing corroded or unsealable roof-penetrating outer surface of the roof penetrating pipe and the rigid smooth cylindrical hollow tube of the cover sleeve provides a new surface against which a flashing can seal.

28. The system of claim 12, wherein the cover sleeve provides the means to cover and enclose non-sealable surfaces of the roof-penetrating pipe, and to provide a new smooth sealing surface for use with the flashing device.

29. The method of claim 19, wherein the cover sleeve enables covering and enclosing of the non-sealable exterior surfaces of the roof-penetrating pipe and the rigid cylindrical hollow tube of the cover sleeve provides a new perfect sealing outer surface used to seal with the flashing device.

* * * * *